United States Patent [19]

Price

[11] 4,118,268

[45] Oct. 3, 1978

[54] SURFACE AND EDGE LAMINATING APPARATUS

[76] Inventor: Edwin Price, 9 E. Frambes Ave., Pleasantville, N.J. 08232

[21] Appl. No.: 777,640

[22] Filed: Mar. 15, 1977

[51] Int. Cl.[2] ..... B26D 3/08

[52] U.S. Cl. ..... 156/510; 83/431; 83/438; 144/2 A; 144/246 B; 144/253 F; 83/875; 83/886

[58] Field of Search ..... 156/211, 216, 257, 268, 156/468, 475, 510, 267, 479, 517; 83/5, 6, 9, 12, 431, 438, 442, 922; 144/7, 42, 136 R, 242 C, 242 D, 309 Q, 246 B, 253 R, 253 B, 253 F, 2 A

[56] References Cited

U.S. PATENT DOCUMENTS

| | | | |
|---|---|---|---|
| 1,394,593 | 10/1921 | Wetmore | 144/7 |
| 2,266,847 | 12/1941 | Calpha et al. | 83/5 |
| 2,610,729 | 9/1952 | Marcantel | 144/253 H |
| 2,817,376 | 12/1957 | Johannsen | 83/5 X |
| 3,275,049 | 9/1966 | Gunn | 144/242 D |
| 3,322,171 | 5/1967 | Cornell | 144/136 R |
| 3,406,612 | 10/1968 | Terzuoli | 156/257 |
| 3,738,403 | 6/1973 | Schwoch et al. | 83/431 X |
| 3,841,369 | 10/1974 | Roche | 83/5 X |

*Primary Examiner*—Michael G. Wityshyn
*Attorney, Agent, or Firm*—Thomas A. Lennox

[57] ABSTRACT

An apparatus and method is provided for scoring, forming and adhering a single sheet of phenolic or similar hard brittle surfacing material to the face and edges of a panel to form kitchen cabinet doors and the like. One face and the edges of the substrate panel are coated with contact adhesive and the face is adhered to the back of a phenolic sheet, also coated with the contact adhesive. The front face of the phenolic sheet is scored in an apparatus utilizing a non-adhering overhanging fence. After scoring, extensions of the phenolic sheet are pressed against the panel edges to cover the four edge surfaces of the panel.

8 Claims, 8 Drawing Figures

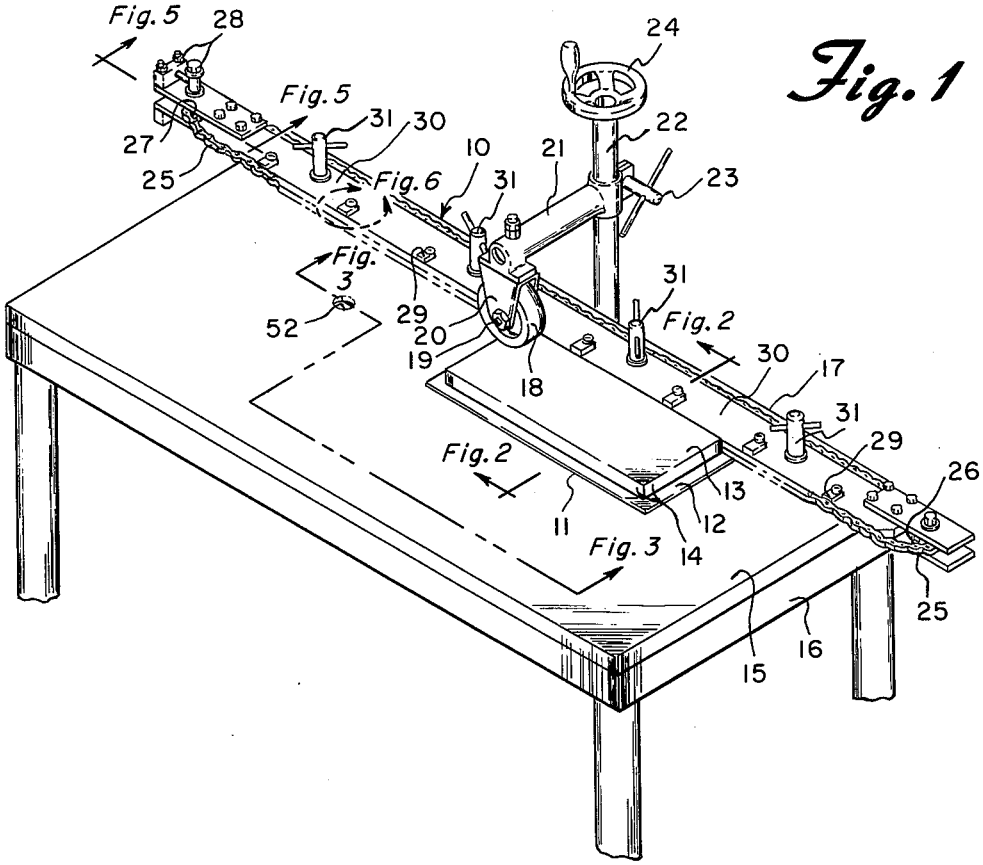
Fig. 1
Fig. 5
28
24
Fig. 5
31
30
22
27
10
21
25
Fig. 6
31
23
Fig. 3
31
52
29
Fig. 2
20
30
19
17
18
31
29
Fig. 2
26
13
11
12
Fig. 3
14
25
16
15
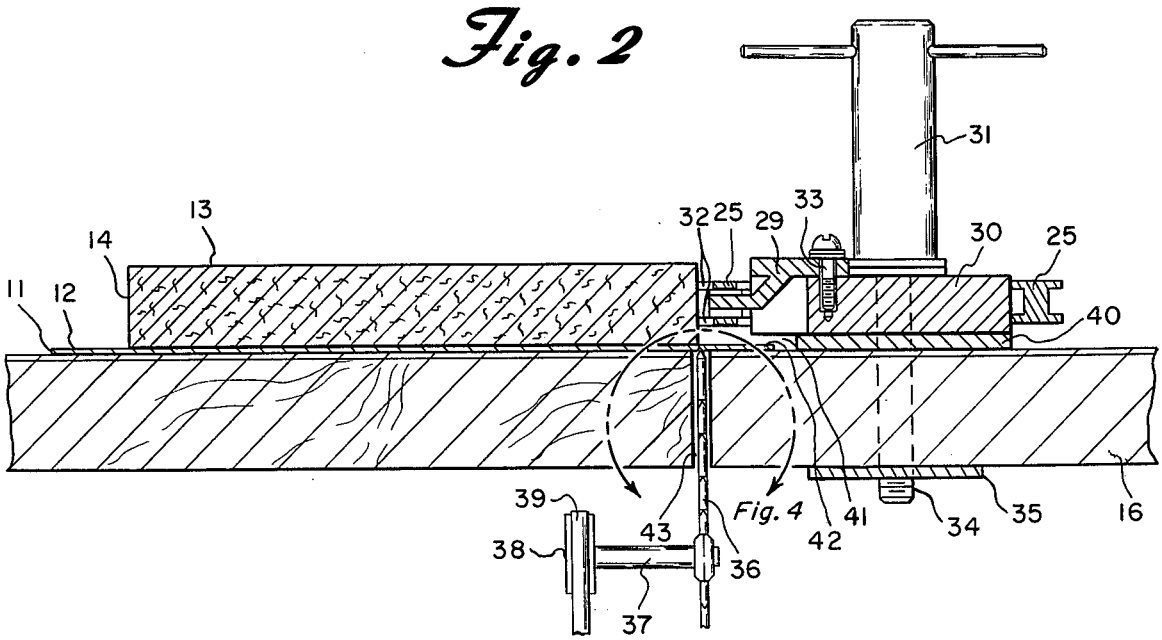
Fig. 2
31
13
32
25
29
33
30
25
14
11
12
40
39
Fig. 4
43
41
34
35
16
38
36
42
37

SURFACE AND EDGE LAMINATING APPARATUS

BACKGROUND OF THE INVENTION

This invention generally relates to methods and apparatus applying durable, rigid and attractive surfacing sheets over structural substrates of more modest appearance. In particular, it is useful in the construction of laminates similar in appearance to that described in U.S. Pat. No. 1,133,106 to W. D. Cuppett, showing a veneer of quality surfacing material over a less expensive substrate.

Through the years, many methods and apparatus have been provided to manufacture this type of construction. With the introduction of extremely durable and attractive high pressure laminates of paper and phenolic and melamine resins, there has been a great need to provide for effective techniques and equipment to manufacture table tops, door panels, wall panels, cabinet doors, counter tops and like structures by laminating the thermoset sheet, generally known and marketed under the trademark "Formica," to less expensive but structural substrate materials. There is no great difficulty, and in fact, home handymen apply these surfacing sheets to plywood or other substrates to form counter-tops, kitchen cabinets and the like. However, the efficient and quick attachment of the surfacing sheet to the edges of the substrate has not been capable of easy solution. It is, of course, possible to first coat the face of the substrate with the surface sheet and then cut strips of laminate and attach them individually to the edges of the panel after which the excess is trimmed away. This requires separate steps and is much too inefficient to allow for large scale production of such items. Complicated and very expensive equipment has been provided to apply rolls of the surfacing sheet to the edges of panels but only the largest of standardized production lines can utilize such a device. This type of machinery merely carries out the same steps as the manual construction, but with highly complicated mechanical devices.

Typical methods of lamination for the surface and edges of such substrate have been disclosed in such patents as U.S. Pat. Nos. 3,322,171 to R. R. Cornell, 3,625,269 to Leif A. Holan, 3,841,369 to E. N. Roche, 3,943,022 to K. J. Susnjara and 3,955,677 to D. S. Collingwood. Essentially all of these devices utilize the system of scoring the rigid surface sheet and breaking it toward the score.

A number of other apparatus have been disclosed for the construction of counter tops, cabinet doors and the like. These include U.S. Pat. Nos. 2,890,919 to H. E. Hansen, 3,389,033 to M. E. Ullman, Jr., 3,392,074 to R. R. Barton, 3,616,076 to J. M. Gepkens and 3,733,975 to C. C. Terrasi. While these patents disclose methods of making this type of construction, they are provided for general background purposes.

U.S. Pat. No. 3,132,982 to R. C. Grimsinger disclosed a method of bending printed electrical circuit panels in the direction of a circular score with outside reinforcement over the bend U.S. Pat. No. 3,655,479 to G. P. Helmes, et al, discloses the method of gluing a strip of material against the side of a flat work piece like a table leaf.

There has been great need in the industry to provide apparatus and a method which will reduce the amount of personal hand labor but yet provide sufficient versatility to allow the piece by piece change from one type of laminate to another and from one size laminate to another. The equipment, apparatus and methods described hereinabove do not satisfy these general requirements.

It is an object of this invention to provide an apparatus which reduces hand labor but eliminates the costly investment in an edge banding machine which only does edges in the color and size set in the machine.

It is the further object of this invention to cut down the waste of the surface sheet material.

It is the further object of this invention to use the identical surfacing sheet for the edges as is used in the top and to maintain the pattern over the edge in an exact match.

It is the further object of this invention to provide a method and apparatus which can be utilized in not only large but small laminating shops or factories in the production of these laminates.

It is the further object of this invention to provide an essentially maintenance free apparatus that is not complicated and may be easily used by relatively unskilled individuals.

It is a further object of this invention to provide an apparatus and method of producing phenolic or melamine high pressure laminated covered panels such as doors, drawer fronts and the like on old kitchen cabinets and like applications.

It is a more specific object of this invention to provide a fence construction which will allow the scoring of a surface sheet when the edge of the substrate panel has been precoated with contact adhesive.

SUMMARY OF THE INVENTION

This invention includes a method of forming and securing rigid surfacing sheet material to the faces and edges of a substrate panel. The method provides for applying contact adhesive to essentially the entire back surface of the rigid surfacing sheet and also to the face of the substrate panel onto which the surface sheet is to be applied and in addition thereto all four edges of the substrate panel. The advantage of being able to apply adhesive to the entire surface without having to, in any way, carefully apply the adhesive in a certain area, is apparent.

The size of the surfacing sheet is at least as large as the combined surface area of the face and edges of the substrate sheet to be covered. The substrate panel face previously coated with the contact adhesive is positioned and placed on the back of the surfacing sheet also covered with the contact adhesive. Both coatings of the contact adhesive are allowed to set according to the manufacturer's instructions before the substrate is adhered to the back of the surfacing sheet.

The surfacing sheet with the substrate panel attached is placed on a supporting surface and the edges, one at a time, are firmly held against and slid along the face of a non-adhering fence, wherein the fence is positioned above the supporting surface to allow the edges of the surfacing sheet extending beyond the edge of the substrate panel to extend under the fence and on top of the supporting surface.

As the combination of the surface sheet and substrate panel are slid along the fence face, a scoring cutter cuts a V-shaped score into the surfacing sheet as it extends upward through the supporting surface. Thus, only the substrate panel edge touches the fence while the front surface of the surfacing sheet is scored from below.

After all the edges have been scored, the corner cutouts of the rigid surface sheet are removed. The extensions of the surfacing sheet are bent upwards and broken toward the edges of the substrate panel. As both surfaces have had contact adhesive applied and set thereon, the pieces immediately seize and are permanently adhered to the sides of the panel. As soon as the edges and excess surfacing sheet are trimmed off, five of the six surfaces of the substrate panel are covered.

This invention utilizes an apparatus for scoring the front surface of a surfacing sheet that is fully coated with contact adhesive on its back surface and permanently adhered to a face of a substrate panel on which contact adhesive is applied to that face and its edges. The apparatus of this invention is utilized on panels with contact adhesive applied to the verticle edges. The apparatus is particularly useful for a laminate of substrate panel and surfacing sheet utilizing contact adhesive between a substrate panel and surfacing sheet but having significant vertical edge area of the substrate panel coated with contact cement at the same time. A surfacing sheet having an area at least as large as the projected surface area of the face and the edges of the substrate panel to be covered is also coated with contact adhesive. A laminate is made by pressing the coated face of the substrate panel to the coated surface of the surfacing sheet allowing the coated edges of the surfacing sheet to extend outwardly.

The combination is placed on a supporting surface with the surfacing sheet on the bottom. A scoring device which includes a router or a circular saw, extends upwardly through an aperture in the supporting surface with the scoring device capable of cutting a score, preferably a V-shaped groove, in the surfacing sheet as it is moved laterally over the scoring means.

A fence device is positioned at a height over the supporting surface so as to allow the edges of the substrate panel to be covered, one at a time, to be pressed in abuttment against the face of the fence device, while the panel is lying on and attached to the surfacing sheet. The fence device is constructed so that it extends over the supporting surface and provides sufficient height and depth such that the extensions of the surfacing sheet extending beyond the substrate panel lie under the fence and do not strike any obstruction.

The fence device has a non-adhering surface such that the contact adhesive on the panel edges in the set condition is not significantly affected and allows the two surfaces to slide easily across each other as the panel is forced tightly against the fence and slid along the fence face to score the surfacing sheet from below.

Throughout the specification the reference to the term "surfacing sheet" is intended to include generally rigid or semi-rigid sheet that would generally require scoring and breaking to conform to sharp 90° angles. This sheet is generally thin by comparison with the substrate to be covered and is typically colored and patterned to form a durable, esthetically appealing surface. The surface sheet is typically phenolic or melamine high pressure laminate sheet material including those goods marketed under the trademark "Formica" although it may include non-ductile metal, rigid and semi-rigid thermoplastic sheets including extruded or cast sheet including polyvinyl chloride polymer sheets and the like.

Throughout the specification the term "substrate panel" is intended to include rigid structural sheets with edges to be covered by the surfacing sheet. The substrate panel is generally rectangular in shape with generally straight edges although it may be somewhat irregular such as having a convex rounded edge. The substrate panel is generally a wood product such as particle board, plywood and the like, formed metal sheet, fiber glass reinforced plastic and like materials.

The apparatus and method of this invention is directed to the use of contact cement or adhesive. This adhesive is typically applied to one face and all four edges of a substrate panel and to the back surface of the surfacing sheet before the apparatus of this invention is utilized.

The contact adhesive is readily available on the commercial market and is the type of adhesive that is applied to two surfaces with each coating being allowed to set and skin-dry to the touch for a period of time, according to the manufacturer's specifications. After the contact adhesive has set, it remains soft for some time and readily becomes deformed if mishandled. In this state, the coated surface, if pressed against an uncoated flat surface will adhere to a minor degree, will exhibit very high sliding coefficient friction between the coated surface and an uncoated surface pressed against it, and leave a deposit on the uncoated surface.

After two surfaces coated with the contact adhesive are allowed to set and then are pressed tightly together, a strong permanent bond is obtained. In fact, when the pre-set coated surfaces touch, they tend to seize each other to form a strong coheasive attachment. This invention takes advantage of the period after the contact adhesive is set and it is still an extremely effective adhesive some time thereafter.

In embodiments of this invention, a primary object is to cover the face and edges of the substrate panel. In the further description of this invention, the term "projected surface area" is used to describe the face area of the substrate, plus sufficient area around that area to include the area of the edges if extended in the same plane as the face area.

In this invention, it is important that the surfacing sheet be cut large enough to cover the edges and be positioned such that the surfacing sheet when folded against the edges, after being permanently attached to the face of the substrate panel, covers all of the edges of the panel. Thus, when the surfacing sheet is described as being larger than the projected surface area of the face and edges of the substrate, it is intended to include the proper shape and positioning of the substrate panel to allow for full coverage of the face and edges of the substrate panel after scoring, breaking, folding and adhering the surfacing sheet to the substrate edges. Thus, for example, when ½ inch thick substrate panel is used, the overhang extension of the surfacing sheet on the edges to be covered is about ⅝ to ¾ of an inch.

BRIEF DESCRIPTION OF DRAWINGS

FIG. 1 is an overall perspective view of the apparatus of this invention with the work piece in position to be scored.

FIG. 2 is a side cross-sectional view along lines 2—2 of FIG. 1 showing the work piece in position and being scored according to this invention.

DESCRIPTION OF PREFERRED EMBODIMENTS

Figure 3:
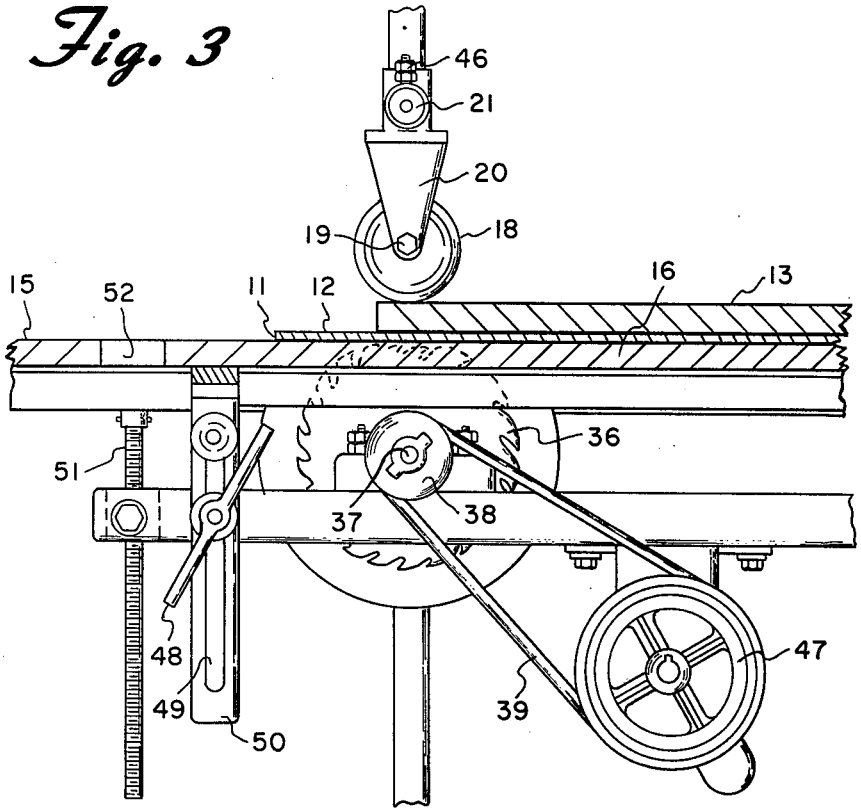
FIG. 3 is a front cross-sectional view along lines 3—3 of FIG. 1 showing the work piece in position and being scored according to this invention.

A surface and edge laminating apparatus 10 is pictured overall in FIG. 1. Work piece 11 being worked on includes surfacing sheet 12, which is a decorative "Formica" brand phenolic-paper high pressure laminate with the front face down and the back face completely covered with contact adhesive. The surfacing laminate preferably is 1/32 inch thick but the device will operate on a wide range of thicknesses including 1/16 inch sheet. Substrate panel 13 is a ½ inch thick wood composition board cut to the size and shape of final use positioned on sheet 12 and held securely by a pre-application of contact cement on the bottom face (hidden) of substrate panel 13 and the back surface of sheet 12. Edges 14 of panel 13 are covered with pre-set contact adhesive, it having been applied when the bottom was coated. The top face of panel 13 is not covered with adhesive. While ½ inch substrate is illustrated, there is no limit to the thickness of the substrate and may be ⅝ inch, ¾ inch or even inches thick.

Work piece 11 rests upon supporting surface 15 of table 16. One of edges 14 of panel 13 is held rigidly against fence system 17 by hand and by rubber pressure roller 18 which is infed to force the workpiece against fence system 17. Roller 18 rotates on axle 19 held by channel 20 on arm 21 which is adjustable horizontally and vertically on shaft 22 by adjustment wing bolt 23.

Fence system 17 includes a standard designed ½ inch pitch continuous roller drive-chain 25 which is held in tension on sprocket gear 26 and adjustable sprocket gear 27. Adjustable sprocket gear 27 is adjusted by chain adjust system 28. Chain 25 is held in tension against adjustable stops 29 on fence plate 30 adjustable in an enlarged hold by wing hold down members 31 which are internally threaded to studs attached to table 16. Fence chain 25 is adjustable horizontally to place the scoring groove directly under edge 14 of panel 13. While the size of chain 25 is not critical, it is preferred that the chain links have rounded edge surfaces and provide at least two points of contact vertically on the work piece 11. Chain 25 is preferably not designed to move with work piece 11 but can be loosened and moved to a new position when worn.

The fence design is critical to this invention and preferably provides minimal contact with coated work piece 11 with rounded contacts to reduce sliding friction with the coated work piece. Fence 17 preferably has at least two contacts in the vertical direction against the work piece.

A side cross-sectional view in FIG. 2 shows work piece 11 including substrate panel 13 adhesively attached to surfacing sheet 12. Edges 14 are coated with pre-set contact adhesive and one edge 14 is shown pressed against edges 32 of chain 25 held in a straight line communication by a tension against one of stops 29 threadably held on fence plate 30 by bolt 33. Plate 30 is held to table 16 by wing member 31 through stud 34 and threaded plate 35.

Circular saw blade 36 is driven by shaft 37 through pulley 38 by drivebelt 39 at a high rate of speed to score a V-shaped notch in surfacing sheet 12.

Fence plate 30 is held off table surface 15 by spacer 40 to form space 41 to allow surfacing sheet extension 42 to extend unobstructed under part of fence system 17 and particularly under chain 25. Spacer 40 is chosen to provide sufficient depth of space 41 at least as long as height of edge 14 and thus the length of extension 42.

Figure 4:
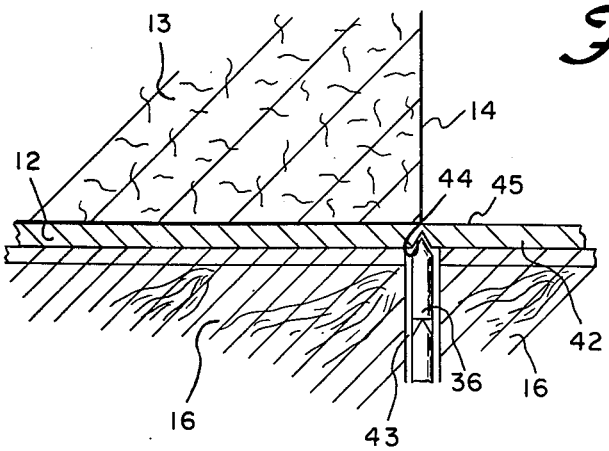
FIG. 4 is an expanded front cross-sectional view along lines 4—4 of FIG. 3 showing the work piece being scored according to this invention.

Slot 43 is provided in table 16 to allow sawblade 36 to extend upwards above table surface 15 to engage and cut V-shaped groove 44 in surface sheet 12. Sawblade 36 is a carbide circular saw blade ground to a 60° angled point (angle is exaggerated for illustration purposes) and rotated at a high rate of speed to cut groove 44 as shown in expanded view FIG. 4 Surface 14 of substrate panel 13 is coated with pre-set contact adhesive as is back surface 45 of extension 42 of surfacing sheet 12. The angle of blade tip may vary from about 45° to 90°, but is preferably about 60°. The depth of V-shaped groove 44 should be at least one-half of the thickness of surfacing sheet 12 and may leave only a few thousandths of an inch thickness at the point of the groove.

A front cross-sectional view of the apparatus is shown in FIG. 3 showing work piece 11 comprising surfacing sheet 12 and substrate panel 13 resting on table top surface 15 and held downwardly and toward the fence by pressure roller 18 rotating on axle 19 held by channel 20 on arm 21 by adjustable bolts 46. Sawblade 36 extends upwardly through table 16 to engage surfacing sheet 12 as work piece 11 is fed parallel to circular saw 36 against the fence to cut the V-shaped groove. Sawblade 36 is driven at a high rate of speed by axle 37 attached to pulley 38 driven by belt 39 through power pulley 47. Sawblade 36 is adjustable vertically by threaded adjustment member 51 and held in place by wing nut 48 along slot 49 of channel 50. Height adjustment by threaded member 51 is made through hole 52 in table 16 using detachable wheel engagement member 24.

Figure 5:
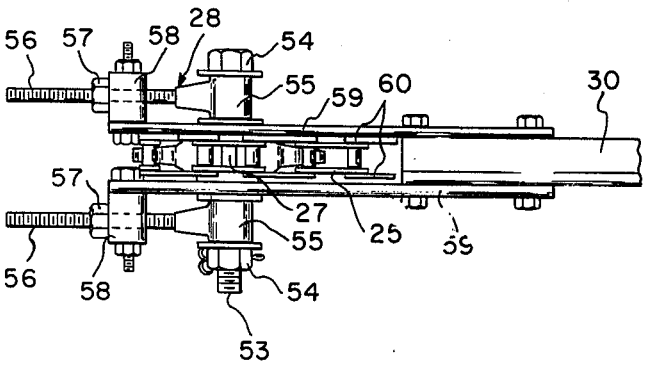
FIG. 5 is a front cross-sectional view along lines 5—5 of FIG. 1 showing the detail of the adjusgment capability of the fence device of this invention.
Figure 6:
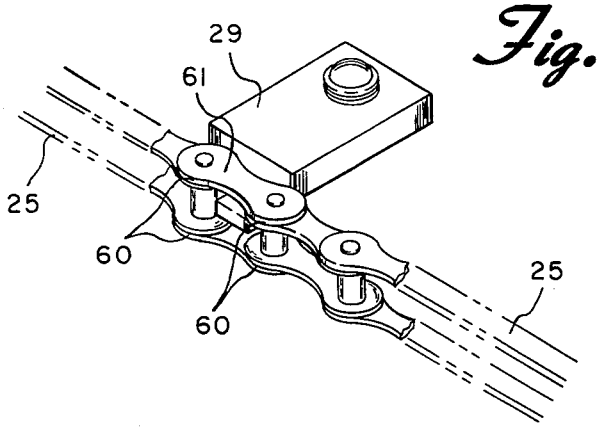
FIG. 6 is a close-up perspective view of the chain fence construction in the apparatus shown in FIG. 1.

A close-up of the chain adjust system 28 of fence system 17 is illustrated in FIG. 5 showing the leading edges 60 of chain 25 held in tension by sprocket gear 27 through bolt 53 held by nut 54 to tension member 55 with the tension adjusted through threaded extensions 56 on which tension is placed by bolt 57 on blocks 58 rigidly attached to plates 59 which extend from and are rigidly bolted to fence plate 30. In this fashion, continuous chain 25 is placed in tension and is balanced to provide a parallel surface face 60 of fence chain 25 as shown on FIG. 6. Edge 14 is firmly held against the parallel points which comprise face 60 of the chain-links 61 of chain 25 which in turn is held by tension against stops 29.

Figure 7:
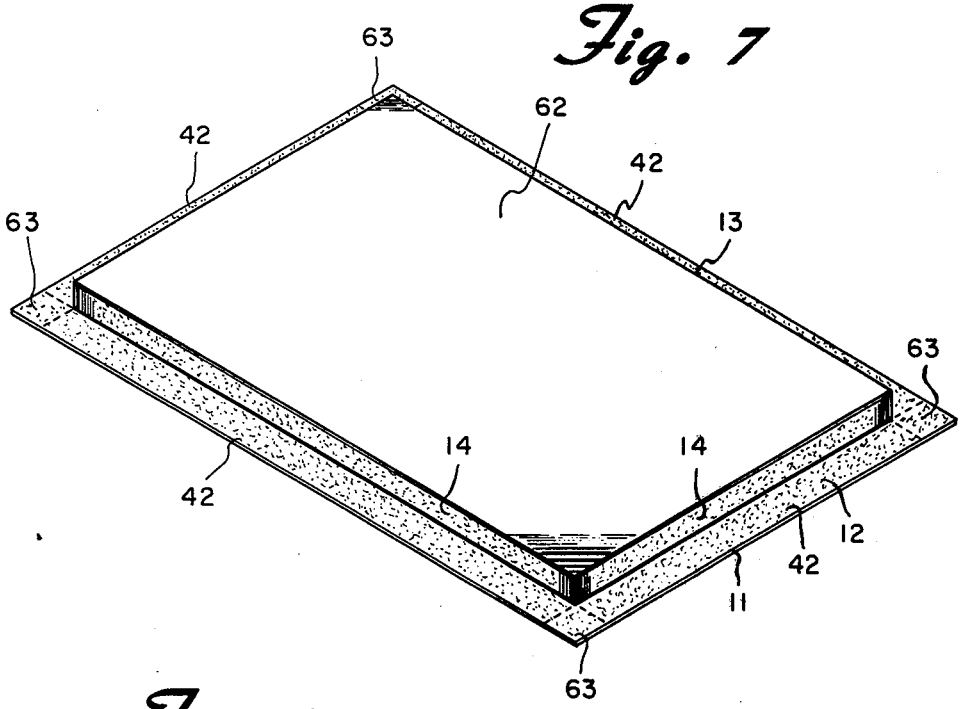
FIG. 7 is a perspective view of a work piece after scoring but before the final steps of adhering the edge covering sheet.
Figure 8:
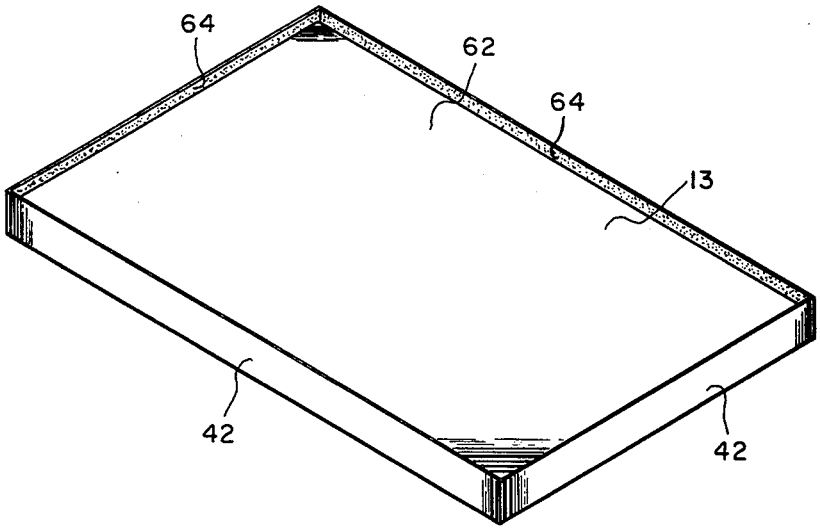
FIG. 8 is a perspective view of a work piece after the edges are covered but before the final trimming operation.

A work piece 11 is shown in expanded view FIG. 7 wherein substrate panel 13 is adhesively bonded to the back of surfacing sheet 12 with contact adhesive as hereinabove. Prior to this step substrate panel 13 was prepared by completely covering one side of a 4 foot by 8 foot panel of ⅝ inch plywood with Formica using contact adhesive. Substrate panel 13 was cut to end use size so that face 62 is covered with Formica sheet. Edges 14 of substrate panel 13 and extensions 42 of surfacing sheet 12 are coated with pre-set contact adhesive before the pieces were joined. After the V-shaped scoring on all edges has been completed, using the apparatus of FIG. 1, corners 63 are broken off and removed and each extension 42 is broken along the score line and folded upwardly to seize through the combined contact adhesive coatings on edge surfaces 14 as shown in FIG. 8. The excesses 64 of surface sheet extensions 42 are trimmed leaving all surfaces of substrate panel 13 covered. It is preferred that the corners broken along the V-shaped score be scraped or smoothed with a draw file or the like.

The prior examples of my invention are merely illustrative of my invention and are not intended to limit the scope of a patent grant. My invention is limited only by the appended claims.

I claim:

1. An apparatus for scoring the front surface of a surfacing sheet, that is fully coated on its back surface with contact adhesive, that has a substrate panel permanently adhered to the back surface of the sheet, that at least one edge of the substrate panel is covered with contact adhesive, and that the area of the surfacing sheet extends beyond that coated edge of the substrate panel with extension area being at least as large as the coated edge of the panel, comprising:

(a) a structure defining a supporting surface for the surfacing sheet on top of which the substrate panel is adhered, (b) a fence means positioned at a height over the supporting surface to abut the coated edge of the substrate panel when the surfacing sheet onto which the panel is adhered is placed on the supporting surface, (c) wherein said fence means extends over the supporting surface providing sufficient space for the surfacing sheet extension under the fence means, (d) a non-adhering surface face means on the fence means against which the contact adhesive coated edge of the substrate panel slides, (e) an aperture in the supporting surface, (f) a scoring means extending upwardly through the aperture under the surface face means capable of cutting a groove at the point under the fence face means in the surfacing sheet as it is moved laterally across the scoring means.

2. The apparatus of claim 1 wherein the fence means is a link roller drive chain having rounded surface edge links to provide minimal contact with the contact adhesive coating on the edges of the substrate panel but provide at least two contacts, spacedly aligned in a vertical direction with the edge of the substrate panel.

3. The apparatus of claim 1 wherein the fence means is a continuous roller drive chain held in tension by two sprockets against pressure stops positioned parallel to the direction in which the panel to be scored is moved along the fence face.

4. The apparatus of claim 1 wherein a pressure roller means is positioned above the scoring means to provide positive pressure to the laminate to maintain close contact of the surface sheet with the supporting surface at the point of scoring and wherein the roller means is infed to force the edge of the substrate panel against the fence means.

5. The apparatus of claim 1 wherein the scoring is less than a 90° V-cut angle.

6. The apparatus of claim 5 wherein the scoring is about a 60° V-cut angle.

7. The apparatus of claim 1 wherein the depth of the score is at least one-half of the thickness of the surfacing sheet.

8. The apparatus of claim 1 wherein the non-adhering surface face means has rounded contacts with at least two contacts spacedly aligned in the vertical direction along the face of the fence means to contact the work piece.

* * * * *